United States Patent [19]

Okutomi et al.

[11] Patent Number: 5,045,281

[45] Date of Patent: Sep. 3, 1991

[54] CONTACT FORMING MATERIAL FOR A VACUUM INTERRUPTER

[75] Inventors: Tsutomu Okutomi, Yokohama; Mikio Okawa, Tama; Atsushi Yamamoto; Tsuneyo Seki, both of Fuchu; Yoshinari Satoh, Kawasaki; Mitsutaka Honma, Tokorozawa; Seishi Chiba; Tadaaki Sekiguchi, both of Yokohama, all of Japan

[73] Assignee: Kabushiki Kaisha Toshiba, Kawasaki, Japan

[21] Appl. No.: 486,259

[22] Filed: Feb. 27, 1990

[30] Foreign Application Priority Data

Mar. 1, 1989 [JP] Japan ..... 1-49066

[51] Int. Cl.[5] ..... C22C 9/00; C22C 30/02

[52] U.S. Cl. ..... 420/497; 200/262; 200/264; 200/266; 420/495

[58] Field of Search ..... 420/497, 495; 200/262, 200/264, 266

[56] References Cited

U.S. PATENT DOCUMENTS

| | | | |
|---|---|---|---|
| 3,827,883 | 8/1974 | Neely | 420/495 |
| 4,008,081 | 2/1977 | Hundstad | 420/495 |
| 4,032,301 | 6/1977 | Hässler | 200/264 |
| 4,135,755 | 5/1979 | Rothkegel et al. | 200/264 |
| 4,137,076 | 1/1979 | Hoyer et al. | 200/264 |
| 4,537,745 | 8/1985 | Hässler et al. | 420/495 |
| 4,547,640 | 10/1985 | Kashiwagi et al. | 200/262 |
| 4,575,451 | 3/1986 | Naya et al. | 420/495 |
| 4,777,335 | 10/1988 | Okutomi et al. | 420/495 |
| 4,784,829 | 11/1988 | Okumura et al. | 200/266 |

*Primary Examiner*—Upendra Roy

*Attorney, Agent, or Firm*—Foley & Lardner

[57] ABSTRACT

A contact forming material for a vacuum interrupter comprising: from 25% to 65% by weight of a highly conductive component comprising Ag and Cu, and from 35% to 75% by weight of an arc-proof component selected from the group consisting of Ti, V, Cr, Zr, Mo, W and their carbides and borides, and mixtures thereof wherein the highly conductive component of the contact forming material comprises (i) a first highly conductive component region composed of a first discontinuous phase having a thickness or width of no more than 5 micrometers and a first matrix surrounding the first discontinuous phase, and (ii) a second highly conductive component region composed of a second discontinuous phase having a thickness or width of at least 5 micrometers and a second matrix surrounding the second discontinuous phase, wherein the first discontinuous phase in the first highly conductive component region is finely and uniformly dispersed in the first matrix at intervals of no more than 5 micrometers, and wherein the amount of the second highly conductive component region based on the total highly conductive component is within the range of from 10% to 60% by weight.

11 Claims, 1 Drawing Sheet

CONTACT FORMING MATERIAL FOR A VACUUM INTERRUPTER

BACKGROUND OF THE INVENTION

This invention relates to a sintered alloy used in a contact forming material for a vacuum interrupter, a vacuum circuit breaker or a vacuum circuit interrupter, and, more particularly, to a contact forming material for a vacuum interrupter having an improved current chopping characteristic and contact resistance characteristic.

Contacts for a vacuum interrupter for carrying out current interruption in a high vacuum utilizing an arc diffusion property in a vacuum, are constituted of two opposing contacts, i.e., stationary and movable contacts. When the current of an inductive circuit such as a motor load is interrupted by means of the vacuum interrupter, an excessive abnormal surge voltage is generated and a load instrument tends to be broken.

The reasons why such an abnormal surge voltage is generated are attributable to phenomena such as chopping phenomenon generated when a small current is interrupted in a vacuum (a current interruption is forcedly carried out before the waveform of an alternating current reaches the natural zero point) and a high-frequency arc-extinguishing phenomenon.

The value Vs of the abnormal surge voltage due to the chopping phenomenon is expressed by a product of the surge impedance Zo of a load circuit and the current chopping value Ic, i.e., $Vs=Zo \cdot Ic$. Accordingly, in order to reduce the abnormal surge voltage Vs, the current chopping value Ic must be decreased.

In order to meet the requirements described above, there have been developed vacuum switches wherein contacts composed of tungsten carbide (WC)-silver (Ag) alloys are used (Japanese Patent Application No. 68447/1967 and U.S. Pat. No. 3,683,138). Such vacuum switches have been put to practical use.

The contacts composed of such Ag-WC alloys have the following feature:

(1) the presence of WC facilitates electron emission;

(2) the evaporation of the contact forming material is accelerated by heating of the surface of electrodes due to collision of field emission electrons;

(3) an arc is remained by decomposing a carbide of the contact forming material by the arc and forming a charge particle;

Consequently, the contacts exhibit a low chopping current characteristic which is excellent.

Another contact forming material exhibiting a low chopping current characteristic is a bismuth (Bi)-copper (Cu) alloy. Such a material has been put to practical use to form a vacuum interrupter (Japanese Patent Publication No. 14974/1960, U.S. Pat. No. 2,975,256, Japanese Patent Publication No. 12131/1966 and U.S. Pat. No. 3,246,979). Of these alloys, those containing 10% by weight (hereinafter referred to as wt%) of Bi (Japanese Patent Publication No. 14974/1960) have suitable vapor pressure characteristics and therefore exhibit low chopping current characteristics. Those containing 0.5 wt% of Bi (Japanese Patent Publication No. 12131/1966) segregate Bi in crystal boundaries and this therefore renders the alloy per se brittle. Thus, a low welding opening force is realized and the alloys have an excellent large current interruption property.

Another contact forming material exhibiting a low chopping current characteristic is an Ag-Cu-WC alloy wherein the ratio of Ag to Cu is approximately 7:3 by weight (Japanese Patent Application No. 39851/1982). In this alloy, a ratio of Ag to Cu which has not been used in the prior art is selected and therefore it is said that stable chopping current characteristic is obtained.

Furthermore, Japanese Patent Application No. 216648/1985 suggests that the grain size of an arc-proofing material (e.g., the grain size of WC) of from 0.2 to 1 micrometer is effective for improving the low chopping current characteristic.

A low surge property is required for vacuum breakers, and therefore a low chopping current characteristic (low chopping characteristic) has been required in the prior art.

In recent years, vacuum interrupters have been increasingly applied to inductive circuits such as motors, transformers or reactors. Accordingly, vacuum interrupters must combine an even more stable low chopping current characteristic and a satisfactory low contact resistance characteristic. This is because it has turned out that abnormal temperature rise of vacuum interrupters due to large current passage associated with large capacity of advanced vacuum interrupters is undesirable for performance of instruments.

Heretofore, there have been no contact forming materials which simultaneously satisfy these two characteristics.

That is, for example, in the contacts composed of WC-Ag alloys, the current chopping value can be reduced by adjusting the amount of WC. However, in this case, the amount of Ag is varied accordingly. Therefore, their contact resistance characteristic can vary. Accordingly, it is necessary to make an attempt to obtain lower stable contact resistance characteristic even if the amount of Ag is the same.

In the contacts composed of the WC-Ag alloys (Japanese Patent Application No. 68447/1967 and U.S. Pat. No. 3,683,138), the chopping current value per se is insufficient, and no regard is paid to the improvement of contact resistance characteristic.

In the 10 wt% Bi-Cu alloys (Japanese Patent Publication No. 14974/1960 and U.S. Pat. No. 2,975,256) the amount of a metal vapor fed to the space between the electrodes is reduced as the number of make and break increases. The deterioration of low chopping current characteristic occurs and the deterioration of withstand voltage occurs depending upon the amount of an element having a high vapor pressure. Furthermore, the contact resistance characteristic is not entirely satisfactory.

In the 0.5 wt% Bi-Cu alloy (Japanese Patent Publication No. 12131/1966 and U.S. Pat. No. 3,246,979), its low chopping current characteristic is insufficient.

In the Ag-Cu-WC alloys wherein the weight ratio of Ag to Cu is approximately 7:3 (Japanese Patent Application No. 39851/1982) and the alloys wherein the grain size of the arc-proofing material is from 0.2 to 1 micrometer (Japanese Patent Application No. 216648/1985), their contact resistance characteristic is not entirely satisfactory.

An object of the present invention is to provide a contact forming material which combines an excellent low chopping current characteristic and contact resistance characteristic and which meets the requirement for a vacuum breaker to be used under severe conditions.

SUMMARY OF THE INVENTION

We have now found that for Ag-Cu-WC contact forming materials, if the contents of Ag and Cu, their ratios and states are optimized if the grain size of an arc-proof component WC is even more refined, and if the states of Ag and Cu are improved, then the object of the present invention is effectively achieved.

A contact forming material for a vacuum interrupter according to the present invention relates to an Ag-Cu-WC contact forming material for a vacuum interrupter comprising a highly conductive component consisting of Ag and Cu and an arc-proof component consisting of W, WC and the like (for convenience sake, the arc-proof component is represented by WC in some cases) wherein (1) the content of the highly conductive component has such a content whereby the total amount of Ag and Cu, (Ag+Cu), is from 25 to 65 wt%;

(2) the content of the arc-proof component is from 35 to 75 wt% wherein the arc-proofing component is selected from the group consisting of W, Mo, Cr, Ti, Zr, their carbides and borides and mixtures thereof;

(3) the highly conductive component of the contact forming materials comprises a first highly conductive component region and a second highly conductive component region, the former comprising a first discontinuous phase having a thickness or width of no more than 5 micrometers and a first matrix surrounding the first discontinuous phase, the latter comprising a second discontinuous phase having a thickness or width of at least 5 micrometers and a second matrix surrounding the second discontinuous phase; and (4) the first discontinuous phase in said first highly conductive component region is finely and uniformly dispersed in the first matrix at intervals of no more than 5 micrometers and the percentage of said second highly conductive component region based on the total highly conductive component, that is, $$\frac{\text{Amount of Second Highly Conductive Component Region}}{\text{Amount of First Highly Conductive Component Region} + \text{Amount of Second Highly Conductive Component Region}}$$

is within the range of from 10 to 60 wt%.

In a preferred embodiment of the present invention, said arc-proof component has an average grain size of no more than 5 micrometers (at least 0.1 micrometer) and a large portion of the arc-proof component can be present in such a state that it is surrounded by the first highly conductive component.

In another preferred embodiment of the present invention, the percentage of Ag based on the total amount of Ag and Cu which are said highly conductive components, [Ag/(Ag+Cu)], can be from 40 to 80 wt%.

In a desirable further embodiment of the present invention, the discontinuous phases and matrices from which the first and/or second highly conductive component regions are formed can be either (i) a Cu solid solution having Ag dissolved therein and an Ag solid solution having Cu dissolved therein, or (ii) an Ag solid solution having Cu dissolved therein and a Cu solid solution having Ag dissolved therein.

The contact forming material according to the present invention can be obtained by the process which comprises the steps of compacting arc-proof material powder into a green compact, sintering the compact to obtain a skeleton of the arc-proof material, infiltrating the voids of the skeleton with the highly conductive material, and cooling the infiltrated material to form the contact forming material.

DETAILED DESCRIPTION OF THE INVENTION

Figure 1:
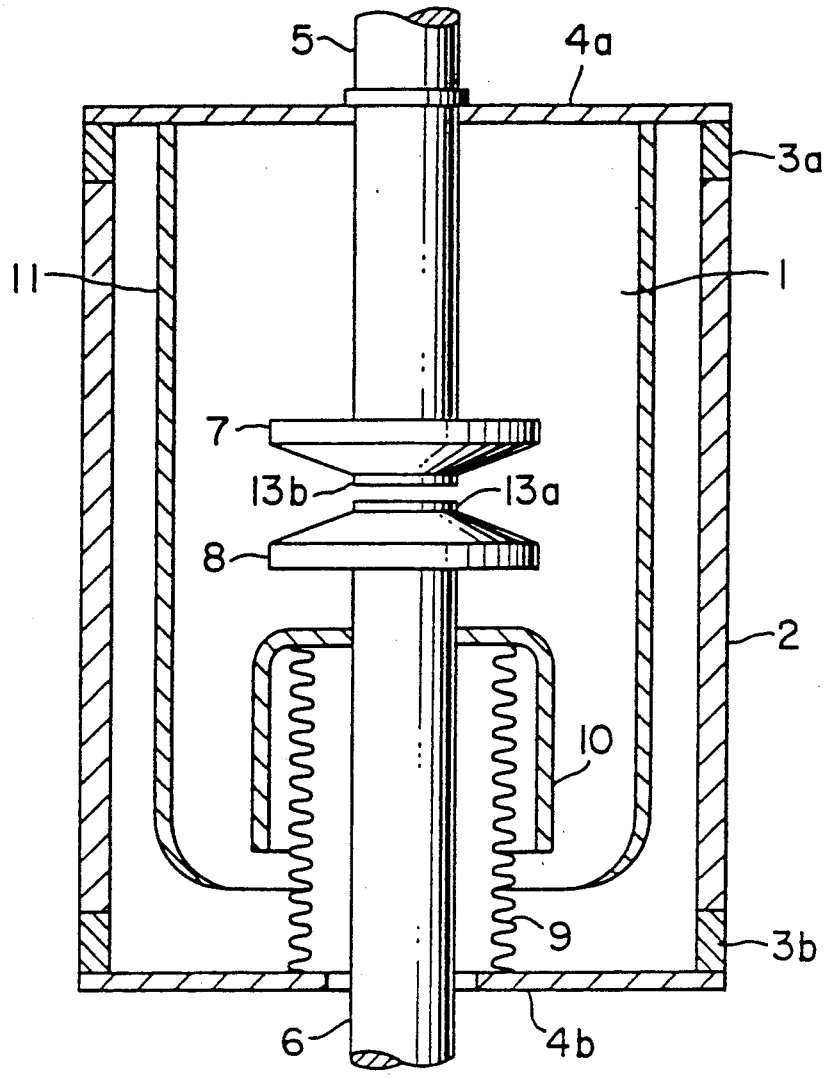
FIG. 1 is a sectional view of a vacuum interrupter to which a contact forming material for the vacuum interrupter according to the present invention is applied.

In the following description, WC is described as a representative example of an arc-proof material.

In order to simultaneously improve the current chopping characteristic and contact resistance characteristic of an Ag-Cu-WC contact forming material, it is important that the amount of Ag+Cu in an alloy, the ratio of Ag to Cu, the states of Ag and Cu, the grain size of WC and the like are controlled within preferred ranges. Particularly, it is extremely important to maintain the current chopping value per se at a lower value. In addition to the foregoing, it is also extremely important to reduce its scattering width. Further, it is extremely important to inhibit its contact resistance characteristic within a specific range. Furthermore, it is extremely important to avoid the change of the contact resistance characteristic associated with the make of break (i.e., to avoid resistance increase). It is believed that the current chopping phenomenon described above be correlated with the amount of a vapor between contacts (vapor pressure and heat conduction as physical properties of a material), and electrons emitted from a contact forming material. According to our experiments, it has turned out that the former provides a larger contribution than the latter. Accordingly, we have found that if the feeding of a vapor is facilitated or if a contact is prepared from a material which is easily fed, the current chopping phenomenon can be alleviated. The Cu-Bi alloy described above has a low chopping value. However, such a Cu-Bi alloy has a fatal drawback in that Bi has a low melting point (271° C.) and therefore Bi melts during baking at a temperature of about 600° C. or during silver brazing at 800° C. carried out usually for vacuum interrupter. The molten Bi migrates and is agglomerated. As a result, the presence of Bi which should maintain current chopping characteristic becomes heterogeneous. Therefore, there is observed a phenomenon wherein the scattering widths of the current chopping value and contact resistance value are increased.

On the other hand, in the Ag and arc-proof material type alloy represented by Ag-WC, the following drawbacks can occur. While the chopping current are influenced by the amount of an Ag vapor at the boiling point of the arc-proof material (in this case, WC), the vapor pressure of Ag is remarkably lower than that of Bi in the Cu-Bi system described above and therefore this leads to thermal shortage, i.e., vapor shortage depending upon the member of a contact (Ag or the arc-proof material) to which the cathode spot is secured. Eventually, it has been confirmed that the scattering width of a current chopping value becomes apparent. It has been thought that it is difficult to prevent the drastical reduction in temperature at the surfaces of a contact at the end of current chopping, by using an alloy composed of a combination of Ag with an arc-proof material and to maintain an arc. It has been concluded that it is necessary to use auxiliary techniques in order to obtain higher performance. The Japanese Patent Application No. 39851/1982 described above discloses an improved process. This Japanese Patent Application suggests a technique wherein crystal grains are finely distributed by using an Ag-Cu alloy as a highly conductive component. According to this technique, the characteristics of the product are drastically stabilized. The situation to which an arc is principally secured is an arc-proof component or an Ag-Cu alloy. In any case, the current chopping phenomenon due to feed of an Ag-Cu vapor is alleviated (improved). However, some scattering can generate when the arc is secured to the arc-proof component.

On the other hand, the scattering width is improved by refining the arc-proof component. Accordingly, this suggests that the grain size of the arc-proof component plays an important role in the current chopping phenomenon and suggests that the grain size in the specific range should be used by considering the observation results showing remarkable scattering in the case of a contact forming material wherein segregation is observed (the size of the arc-proof component is from about 10 to about 20 times its initial grain size).

While its chopping current characteristic is improved by controlling the amounts of Ag and Cu and the grain size of WC to specific values as described in Japanese Patent Application No. 39851/1982, the technique described therein neither provides a lower chopping current characteristic, nor ensures a low and stable contact resistance characteristic.

As described above, in the contact forming material of the present invention, the refinement and homogenization of the structure of contacts are achieved by utilization of a fine WC powder and utilization of preferred states of Ag and Cu. Accordingly, stable current chopping characteristic and excellent contact resistance characteristic are obtained. While stable current chopping characteristic is obtained by Ag and Cu evaporated by means of arc heat during the make-and-break process even after multiple make-and-break processes, the contact resistance characteristic can exhibit increased variation and abnormally high contact resistance can occur. According to our observation, it is believed that the reason why such a phenomenon occurs is as follows. The shortage of the amounts of Ag and Cu occurs by selective evaporation of Ag and Cu components in the periphery of WC overheated by arc, and an assembly composed of substantially WC is formed. When such assemblies come into contact with each other, the contact resistance is increased. The reason why the current chopping characteristic is not deteriorated is a synergistic effect of contribution of the above special states of Ag and Cu, and contribution of supplement of gaseous Ag and Cu obtained from the inner portion. This is supported by the fact that the presence of an extremely thin Ag/Cu film at the surface of the assembly composed of substantially WC be observed by analysis. However, such an extremely thin Ag/Cu film contributes scarcely to maintenance of the contact resistance characteristic. While the current chopping characteristic is ensured by the effect of supplement of Ag and Cu by means of arc, it is difficult to maintain the contact resistance characteristic.

In order to improve such drawbacks, in the present invention, Ag and Cu coexist; Ag and Cu are present in a such state that they have a grain size of no more than 5 micrometers and are finely and uniformly dispersed; and particularly Ag and Cu pools having a grain size of at least 5 micrometers are present in a specific ratio. Thus, the contact resistance characteristic is stable even after multiple make-and-break processes. Further, both excellent current chopping characteristic and excellent contact resistance characteristic can be obtained at the same time while the current chopping characteristic is maintained at a good level.

The value of current chopping is stabilized to a low level by the first highly conductive component region composed of the first discontinuous phase having a thickness or width of no more than 5 micrometers and the first matrix surrounding the first discontinuous phase. The second highly conductive component region composed of the second discontinuous phase having a thickness or width of at least 5 micrometers and the second matrix surrounding the second discontinuous phase plays such a role that Ag and Cu which may contribute to increase of contact resistance after multiple make-and-break processes are supplemented to the deficient portions due to evaporation. Thus, Ag and Cu are present in the whole surface of contact faces in a suitable amount, whereby the stable current chopping characteristic and the excellent contact resistance characteristic can be obtained at the same time.

For purpose of stabilizing current chopping characteristic, a WC powder having a grain size of no more than 3 micrometers is used and highly conductive components Ag and Cu are finely and uniformly dispersed. Accordingly, in microporous portions wherein Ag and Cu are evaporated by arc, Ag and Cu are lost and their shortage occurs. In the case of an arc during the small current switching processes which occurs a current chopping phenomenon, there is no energy necessary for melting Ag and Cu from the lower inner portion and embedding them in the microporous portions. Ag and Cu are supplemented to form only a thin film. While such supplemented amounts are the amounts of Ag and Cu effective for relaxing a current chopping phenomenon, the microscopic shortage of Ag and Cu occurs with respect to the contact resistance value. Accordingly, it is necessary to provide a supplement source of Ag and Cu to the contact surface in order to maintain contact resistance characteristic stably even after multiple make-and-break processes. According to our experiments, it has been found that, if a pool of Ag and Cu having a grain size of at least 5 micrometers (second highly conductive component region) is present, the desired effect is achieved. However, according to our experiments, a pool of Ag and Cu having a grain size of more than 100 micrometers increases the probability of contact of Ag/Cu pools and exhibits tendency to melt them in some cases. Ag and Cu having a too large grain size are undesirable. The presence of WC in the pools of Ag and Cu having a grain size of at least 5 micrometers is undesirable because the presence of WC prevents Ag/Cu from smoothly supplementing, because discrete WC is deposited on the surface of electrodes when Ag and Cu are supplemented and because the presence of WC reduces withstand voltage.

In order to improve both current chopping characteristic and contact resistance characteristic, in the present invention, first, Ag and Cu which are highly conductive components coexist. There are formed a matrix and a discontinuous phase (a layer-shaped structure or a rod-shaped structure) of (1) an Ag solid solution having Cu dissolved therein and (2) a Cu solid solution having Ag dissolved therein. The thickness or width of the discontinuous phase is no more than 5 micrometers and the discontinuous phase is finely and uniformly dispersed in the matrix at intervals of no more than 5 micrometers, whereby the highly conductive component is designed so that it is equal to or preferably less than the size of an arc spot diameter. As a result, the melting points of Ag and Cu components which principally perform a function of maintaining and sustaining an arc (hereinafter referred to as an arc maintaining material) are lowered and their vapor pressure is simultaneously increased.

Second, the average grain size of a WC grain is no more than 1 micrometer, preferably no more than 0.8 micrometer, and more preferably no more than 0.6 micrometer. This requirement aids in converting the dispersion of the arc maintenance material to an even more highly finely dispersed state. Even if only the contents of the highly conductive components (Ag and Cu) and their ratios are specified in the specific ranges, the desirable low chopping characteristic and desirable contact resistance characteristic cannot be obtained at the same time, as shown in Examples and Comparative Examples described hereinafter. According to the present invention, the structures of the highly conductive components (Ag and Cu) are highly refined and stabilized by combining the specific average grain size of a WC grain with specific values for the highly conductive components. Further, WC grains and highly conductive components perform respective functions and the objects are achieved. Thus, the contents of Ag and Cu, their ratios and state are specified and the grain size of the arc-proof component WC is even more refined, whereby low chopping characteristic and contact resistance characteristic can be simultaneously improved.

The present invention will now be described with reference to attached drawings.

Figure 2:
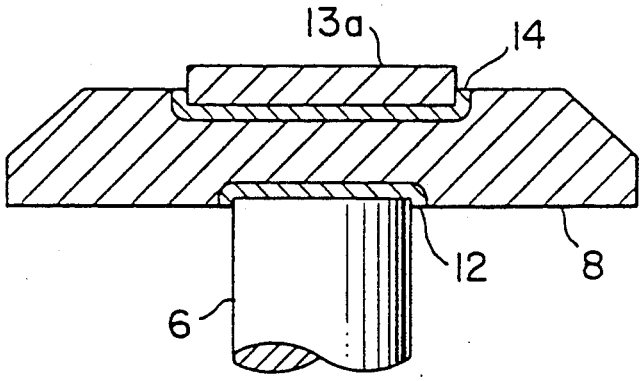
FIG. 2 is an enlarged sectional view of the electrode portion of the vacuum interrupter shown in FIG. 1.

FIG. 1 is a sectional view of a vacuum interrupter and FIG. 2 is an enlarged sectional view of the electrode portion of the vacuum interrupter.

In FIG. 1, reference numeral 1 shows an interruption chamber. This interruption chamber 1 is rendered vacuum-tight by means of a substantially tubular insulating vessel 2 of an insulating material and metallic caps 4*a* and 4*b* disposed at its two ends via sealing metal fittings 3*a* and 3*b*.

A pair of electrodes 7 and 8 fitted at the opposed ends of conductive rods 5 and 6 are disposed in the interruption chamber 1 described above. The upper electrode 7 is a stationary electrode, and the lower electrode 8 is a movable electrode. The electrode rod 6 of the movable electrode 8 is provided with bellows 9, thereby enabling axial movement of the electrode 8 while retaining the interruption chamber 1 vacuum-tight. The upper portion of the bellows 9 is provided with a metallic arc shield 10 to prevent the bellow 9 from becoming covered with arc and metal vapor. Reference numeral 11 designates a metallic arc shield disposed in the interruption chamber 1 so that the metallic arc shield covers the electrodes 7 and 8 described above. This prevents the insulating vessel 2 from becoming covered with the arc and metal vapor. As shown in FIG. 2 which is an enlarged view, the electrode 8 is fixed to the conductive rod 6 by means of a brazed portion 12, or pressure connected by means of a caulking. A contact 13*a* is secured to the electrode 8 by brazing as at 14. A contact 13*b* is secured to the electrode 7 by brazing.

One example of a process for producing the contact forming material will be described. Prior to production, the arc-proof component and the auxiliary components are classified on a necessary grain size basis. For example, the classification operation is carried out by using a sieving process in combination with a settling process to easily obtain a powder having a specific grain size. First, the specific amount of WC having a specific grain size, and a portion of the specific amount of Ag having a specific grain size are provided, mixed and thereafter pressure molded to obtain a powder molded product.

The powder molded product is then calcined in a hydrogen atmosphere having a dew point of no more than −50° C. or under a vacuum of no more than $1.3\times10^{-1}$ Pa at a specific temperature, for example, 1,150° C. (for one hour) to obtain a calcined body.

The specific amount of Ag-Cu having a specific ratio is then infiltrated into the remaining pores of the calcined body for one hour at a temperature of 1,150° C. to obtain an Ag-Cu-WC alloy. While the infiltration is principally carried out in a vacuum, it can also be carried out in hydrogen.

The production of the first and second regions in the highly conductive component and the control of the amount of these regions are carried out as follows. A previously provided WC powder having a grain size of no more than 3 micrometers is classified in a specific ratio. The WC powder having a grain size of 3 micrometers is used as it is, whereas materials which can be evaporated and removed during the sintering process, for example, paraffin is incorporated into the WC powder having a grain size of no more than 3 micrometers to form a mixture. Both materials (only WC powder having a grain size of no more than 3 micrometers and the WC powder having paraffin mixed therewith) are mixed in a specific ratio, and the resulting mixture is pressed. The portions occupied by paraffin during the molding process form a void in evaporating and removing the paraffin by heating during the sintering process when a WC skeleton is formed. An infiltrant (Ag and Cu) infiltrates into the void described above during the subsequent infiltration process to obtain a pool having a size larger than Ag and Cu infiltrated between the WC grains having a grain size of no more than 3 micrometers. During this process, the ratio of the amount of the first highly conductive component region to the amount of second highly conductive component region can be adjusted by regulating the weight ratio of only WC powder to paraffin/WC powder mixture. Ag and Cu infiltrated between WC powders form a first highly conductive component region, whereas Ag and Cu infiltrated into the void obtained by removing paraffin form a second highly conductive component region.

The control of the ratio Ag/(Ag+Cu) of the conductive components in the alloy was carried out as follows: For example, an ingot previously having a specific ratio Ag/(Ag+Cu) was subjected to vacuum melting at a temperature of 1,200° C. under a vacuum of $1.3\times10^{-2}$ Pa and the resulting product was cut and used as a stock for infiltration. Another process for controlling the ratio Ag/(Ag+Cu) of the conductive components can be carried out by previously mixing a portion of the specific amounts of Ag or Ag+Cu in WC, and thereafter infiltrating the remaining Ag or Ag+Cu in order to make a calcined body. Thus, a contact forming alloy having a desired composition can be obtained.

A method of evaluating data obtained in Examples of the present invention and the evaluation conditions are described below.

(1) Current Chopping Characteristic

Each contact was secured and evacuated to no more than $10^{-3}$ Pa to prepare an assembly-type vacuum interrupter. The contacts of this vacuum interrupter was opened at an opening rate of 0.8 m/sec., and a current chopping was measured obtained when a small inductive current was interrupted. The interrupting current was 20 amperes (an effective value) and the frequency was 50 Hz. The opening phase was randomly carried out and the chopping current obtained was measured there when current interruption was carried out 500 times with respect to the respective three contacts. Their average and maximum values are shown in Tables 1 through 3. The numerical values are relative values obtained when the average of the chopping current value of Example 2 is expressed as 1.0.

(2) Contact Resistance

The contact resistance characteristic is measured as follows. A flat electrode having a diameter of 50 mm and having a degree of surface roughness of 5 micrometers and a convex electrode having a curvature radius of 100 R and having the same degree of a surface roughness as that of the flat electrode are opposed. The two electrodes are mounted on a demountable vacuum vessel which has a switching operation mechanism and which has been evacuated to a degree of vacuum of no more than $10^{-3}$ Pa. A load of 1.0 kg and a flowing current of 100 amperes are applied thereto. The contact resistance is determined from the fall of a potential obtained when an alternating current of 10 amperes is applied to the two electrodes. The value of the contact resistance is a value including, as a circuit constant, the resistance or contact resistance of a wiring material and a switch from which a measurement circuit is produced.

The value of contact resistance includes the resistance of the axial portion of a mountable vacuum switchgear per se of from 1.8 to 2.5$\mu\Omega$, and the resistance of the coil portion for the generation of magnetic field of from 5.2 to 6.0$\mu\Omega$, and the balance is a value of the portion of contacts (the resistance and contact resistance of the contact forming alloy).

The contact resistance values shown in Tables 1 through 3 are shown by the scattering width obtained (i) between 1 and 100.and (ii) between 9,900 and 10,000 when a 10,000 make and break test is carried out.

(3) Contact under Test

The materials from which the contacts under test are produced and the corresponding specific data are shown in Tables 1 through 3.

As shown in Tables, the amount of Ag+Cu in an Ag-Cu-WC alloy was varied within the range of from 16.2 wt% to 88.3 wt%, the ratio of Ag to Ag plus Cu, (Ag/Ag+Cu), was varied within the range of from 0 to 100 wt%, and the amount of the second highly conductive component region based on the total highly conductive component was 5%, 10-30%, 30-40%, 40-60% or 60-90% selected by microscopic evaluation of many contacts. These contacts are obtained by controlling factors such as the mixing amount of the material spattering during the sintering process of the skeleton; sintering temperature; and molding pressure as described above.

Further, the grain size and type of the arc-proof component used were varied to evaluate the characteristics of the contacts.

These conditions and the corresponding results are shown in Tables 1 through 3.

EXAMPLES 1 THROUGH 3 AND COMPARATIVE EXAMPLES 1 AND 2

A WC powder having an average grain size of 0.76 micrometer and Ag and Cu powders having each an average grain size of 5 micrometers are provided. These are mixed at a specific ratio, and thereafter, molded while suitably selecting the molding pressure in the range of from zero to 8 metric tons per square centimeter so that the amount of the remaining void present after sintering is adjusted. In the cases wherein the amount of Ag+Cu in the alloys is large (Example 3: Ag+Cu=65 wt%; and Comparative Example 2: Ag+Cu=88.3 wt%), there is used a process wherein the molding pressure is particularly low, or another process wherein a portion of Ag+Cu is previously mixed with WC to obtain a mixture and the mixture is molded. In order to control the amount of the second highly conductive component, in molding the WC powder, a material such as paraffin was deposited on the surface of a portion of the WC powder, i.e., 40% of the total WC powder, the treated material was mixed with the remainder of the WC powder having no paraffin deposited thereon. The resulting mixture was molded and sintered. In Example 1 and Comparative Example 1, the mixture is sintered at a temperature of, for example, from 1,100° C. to 1,300° C. to obtain a WC sintered body. In Examples 2 and 3 and Comparative Example 2, the mixture is sintered at a temperature of less than 1,100° C. to obtain a sintered body. Thus, the amount of the void was adjusted, the amount of Ag+Cu was controlled, and the size of the void was adjusted to control the amount of the first and second conductive component regions.

Ag and Cu is infiltrated into the void of a WC skeleton having such different void levels at a temperature of from 1,000° to 1,100° C. (if necessary, Cu is previously and separately fed and only Ag is infiltrated) to eventually obtain alloys wherein the amount of Ag+Cu in the Ag-Cu-WC alloys is from 16.2 to 88.3 wt% (Examples 1 through 3 and Comparative Examples 1 and 2). These contact stocks were processed into a specific shape, and chopping characteristic and contact resistance characteristic were evaluated under the conditions described above by the evaluation methods described above.

As described above, the chopping characteristic was evaluated by comparing its characteristic obtained when current interruption was carried out 500 times. As can be seen from Comparative Examples 1 and 2 and Examples 1 through 3 shown in Table 1, the average of chopping values obtained by using the amount of Ag+Cu in the alloys is no more than 2 when the average of the chopping value of Example 2 (Ag+Cu=44.4 wt%, and Ag/(Ag+Cu)=71.3%) was expressed as 1.0 (the increase in average of chopping values exhibiting deterioration of characteristic). When Ag+Cu=16.2 wt% (Comparative Example 1) and Ag+Cu=88.3 (Comparative Example 2), the maximum is higher. In contrast, when Ag+Cu is from 25 to 65 wt% (Examples 1 through 3), the maximum is less than 2.0 (their characteristic being good). In particular, it is observed that when large number of current interruption is carried out, the chopping characteristic of contacts having a small amount of Ag+Cu such as Comparative Example 1 (Ag+Cu=16.2 wt%) is deteriorated after about 2,000 switching operation.

On the other hand, contact resistance characteristic is evaluated. Characteristic of Example 2 is used as a standard 100 to examine a relative value. When the amount of Ag+Cu is from 25 to 65 wt% (Examples 1 through 3 ), stable characteristic is obtained. When the amount of Ag+Cu is 16.2 wt% (Comparative Example 1) and 88.3 wt% (Comparative Example 2), the determined values described above tend to increase (their characteristics being deteriorated). It is observed that the contact resistance characteristic be deteriorated. Particularly, in Comparative Example 1, after multiple make-and-break processes (after from 9,900 to 10,000 make-and-break processes) the contact resistance tends to increase due to the shortage of the total amount of the highly conductive components). A further test exhibits the generation of welding. Accordingly, it is preferred that the amount of Ag+Cu in the Ag-Cu-WC alloy be in the range of from 25 to 65 wt% from the stand points of both chopping characteristic and contact resistance characteristic.

EXAMPLES 4 THROUGH 6 AND COMPARATIVE EXAMPLES 3 THROUGH 6

As described above, it has turned out that, even if the amount of Ag+Cu is in the preferred range, i.e., the range of from 25 to 65 wt%, the chopping characteristic and contact resistance characteristic are deteriorated unless the ratio of Ag to Ag+Cu of the Ag-Cu-WC alloy is appropriate. That is, when the value of Ag/(Ag+Cu) was from 40 to 80 wt% (Examples 4 through 6), preferred chopping characteristic (their relative value being no more than 2.0) and preferred contact resistance characteristic (their value being no more than 125$\mu\Omega$ even after a number of make and break) were obtained.

It is observed that, when the value of Ag/(Ag+Cu) is 90.1 wt% and 100 wt% (Comparative Examples 3 and 4), a high heat conduction property is observed. Furthermore, it is observed that, when the value of Ag/(Ag+Cu) is from 22.2 wt% to zero (Comparative Examples 5 and 6), their chopping characteristic is reduced principally due to shortage of the amount of Ag which is a vapor source.

EXAMPLES 7 AND 8 AND COMPARATIVE EXAMPLES 7 AND 8

Contacts were used as specimens wherein the amount of the second highly conductive component region based on the highly conductive component in an Ag-Cu-WC alloy was 5%, 10-30%, 40-60%, or 60-90% (Comparative Example 7, Examples 7 and 8, and Comparative Example 8) wherein the amount of the second highly conductive component region was obtained by adjusting conditions such as pressure in the repressurizing process and infiltration temperature used in treating a WC skeleton having a specific void size wherein the amount of Ag plus Cu of the skeleton and Ag/(Ag+Cu) were controlled to from about 45 to about 48 wt% and from about 71 to about 73 wt%, respectively, by adjusting the amount of paraffin deposited onto WC and the sintering temperature as described above.

As shown in Table 2, when the amount of the second highly conductive component region described above is 10-30% or 40-60% (Examples 7 and 8), stable chopping characteristic is obtained, and there is not large difference in contact resistance characteristics in both cases of a make-and-break initial period (1-100 make-and-break processes) and multiple make-and-break processes (9,900-10,000 make-and-break processes), and stable and good values are obtained. In contrast, in Comparative Example 7 wherein the amount of the highly conductive component region is smaller, the chopping characteristic is extremely good. However, the contact resistance value after multiple make-and-break processes (after 9,900-10,000 make-and-break processes) is remarkably large and exhibits a tendency lacking in stability when the surface of the contacts in such a state is observed, there are seen portions deficient in conductive components (Ag, Cu or Ag). When the amount of the second highly conductive component region is larger (Comparative Example 8), the contact resistance in a make-and-break initial period is low. However, after multiple make-and-break processes, there are low and preferable values, and high values. Thus, scattering occurs due to local surface melting (second highly conductive component region) and evaporation. Accordingly, it is necessary that the amount of the second highly conductive component region exhibiting the specific state of Ag and Cu be within the range of from 10 to 60 wt%.

EXAMPLES 9 AND 10 AND COMPARATIVE EXAMPLES 9 AND 10

In all of Examples 1 through 8 and Comparative Examples 1 through 8, the grain size of the arc-proof component used was 0.76 micrometer. The grain size of the arc-proof component particularly affects the maximum of the chopping characteristic. That is, when the grain size of WC is in the range of from 0.1 to 5 micrometers (Examples 9 and 10), the relative value of the chopping characteristic is no more than 20 and such a grain size poses no problems. When the grain size of WC is 10 and 44 micrometers (Comparative Examples 9 and 10), chopping characteristic is deteriorated and contact resistance characteristic exhibits scattering. Particularly, when the grain size is 44 micrometers (Comparative Example 10), the homogeneity of the entire structure is also inhibited.

EXAMPLES 11 THROUGH 27

While Examples 1 through 10 exhibit the effect of the amount of the second highly conductive component region based on the highly conductive component in a system containing predominantly WC as the arc-proof component, on chopping characteristic and contact resistance characteristic, it has been found that the effect of the second highly conductive component region can be also obtained in the cases of other arc-proof components (Examples 11 through 27).

A large portion of the arc-proof component is surrounded by the first highly conductive component. If a large amount of the arc-proof component is present in the second highly conductive component, the hardness of the second highly conductive component which should play a part of a role of maintaining contact resistance at a low level will be increased and thus presence of a large amount of the arc-proof component in the second highly conductive component will be disadvantageous to contact resistance. Further, the arc-proof component remaining during the Ag/Cu supplement process from the second conductive component will fall off and spatter to cause the reduction in voltage withstanding capability. Accordingly, it is indispensable that the presence of the arc-proof component in the second highly conductive component region be minimized.

TABLE 1

| | Contact Forming Material under Test Highly Conductive Component | | | | | |
|---|---|---|---|---|---|---|
| | Ag (wt %) | Cu (wt %) | [Ag + Cu] (wt %) | $\frac{Ag}{(Ag + Cu)} \times 100$ | $\frac{y}{(x + y)} \times 100$ x . . . Amount of First Highly Conductive Component Region y . . . Amount of Second Highly Conductive Component Region | Arc-proof Component Grain Size and Type of Arc-proof Component |
| Comp.Exam.1 | 11.5 | 4.7 | 16.2 | 70.9 | 30-40% | 0.76 μm WC |
| Exam. 1 | 18.2 | 6.8 | 25.0 | 72.7 | 30-40% | 0.76 μm WC |
| Exam. 2 | 31.7 | 12.7 | 44.4 | 71.3 | 30-40% | 0.76 μm WC |
| Exam. 3 | 46.9 | 18.1 | 65.0 | 72.1 | 30-40% | 0.76 μm WC |
| Comp. Exam. 2 | 63.2 | 25.1 | 88.3 | 71.6 | 30-40% | 0.76 μm WC |
| Comp. Exam. 3 | 50.7 | 0 | 50.7 | 100 | 30-40% | 0.76 μm WC |
| Comp. Exam. 4 | 42.2 | 4.6 | 46.8 | 90.1 | 30-40% | 0.76 μm WC |
| Exam. 4 | 37.8 | 9.5 | 47.3 | 80.0 | 30-40% | 0.76 μm WC |
| Exam. 5 | 26.4 | 16.5 | 42.9 | 61.6 | 30-40% | 0.76 μm WC |
| Exam. 6 | 18.3 | 27.5 | 45.8 | 40.0 | 30-40% | 0.76 μm WC |
| Comp. Exam. 5 | 9.7 | 34.2 | 43.9 | 22.2 | 30-40% | 0.76 μm WC |
| Comp. Exam. 6 | 0 | 46.2 | 46.2 | 0 | 30-40% | 0.76 μm WC |

| | Evaluation Result | | | | |
|---|---|---|---|---|---|
| | Current Chopping Characteristic Relative Value obtained when the Average Value of Example 2 is expressed as 1.00 (Number of Contents: 3) | | Contact Resistance Characteristic | | |
| | | | Value during 1-100 Make-and-Break processes | Value during 9.900-10.000 Make-and-Break processes | |
| | Average | Maximum | (μΩ) | | Remark |
| Comp. Exam. 1 | 1.4 | 2.2 | 60-125 | 145-235 | Welding Generation; Current carrying capacity shortage |
| Exam. 1 | 1.2 | 1.6 | 35-75 | 60-85 | |
| Exam. 2 | (1.0) | 1.2 | 30-65 | 55-85 | |
| Exam. 3 | 1.3 | 1.8 | 30-70 | 70-95 | |
| Comp. Exam. 2 | 1.6 | 3.2 | 35-70 | 105-115 | |
| Comp. Exam. 3 | 1.3 | 2.3 | 30-60 | 60-80 | |
| Comp. Exam. 4 | 1.4 | 2.2 | 35-65 | 65-85 | |
| Exam. 4 | 1.2 | 1.7 | 45-80 | 70-90 | |
| Exam. 5 | 1.3 | 1.8 | 45-90 | 70-100 | |
| Exam. 6 | 1.4 | 1.9 | 50-90 | 85-125 | |
| Comp. Exam. 5 | 2.3 | 3.6 | 60-100 | 105-240 | |
| Comp. Exam. 6 | 3.3 | 4.5 | 65-115 | 120-370 | |

TABLE 2

| | Contact Forming Material under Test Highly Conductive Component | | | | | |
|---|---|---|---|---|---|---|
| | Ag (wt %) | Cu (wt %) | [Ag + Cu] (wt %) | $\frac{Ag}{(Ag + Cu)} \times 100$ | $\frac{y}{(x + y)} \times 100$ x . . . Amount of First Highly Conductive Component Region y . . . Amount of Second Highly Conductive Component Region | Arc-proof Component Grain Size and Type of Arc-proof Component |
| Comp. Exam. 7 | 35.1 | 13.1 | 48.2 | 73.2 | 5% | 0.76 μm WC |
| Exam. 7 | 32.5 | 12.8 | 45.3 | 71.7 | 10-30% | 0.76 μm WC |
| Exam. 8 | 34.1 | 13.1 | 47.2 | 72.6 | 40-60% | 0.76 μm WC |
| Comp. Exam. 8 | 33.5 | 12.9 | 46.4 | 72.1 | 60-90% | 0.76 μm WC |
| Exam. 9 | 34.5 | 12.0 | 46.5 | 74.2 | 30-40% | 0.1 μm WC |
| Exam. 10 | 33.8 | 13.4 | 47.2 | 71.6 | 30-40% | 5 μm WC |
| Comp. Exam. 9 | 35.0 | 13.3 | 48.3 | 72.5 | 30-40% | 10 μm WC |
| Comp. Exam. 10 | 33.3 | 11.9 | 45.2 | 73.6 | 30-40% | 44 μm WC |

| | Evaluation Result | | | | |
|---|---|---|---|---|---|
| | Current Chopping Characteristic Relative Value obtained when the Average Value of Example 2 is expressed as 1.00 (Number of Contents: 3) | | Contact Resistance Characteristic | | |
| | | | Value during 1-100 Make-and-Break processes | Value during 9.900-10,000 Make-and-Break processes | |
| | Average | Maximum | (μΩ) | | Remark |
| Comp. Exam. 7 | 0.9 | 1.2 | 90-110 | 120-575 | |
| Exam. 7 | 1.0 | 1.2 | 50-75 | 60-100 | |
| Exam. 8 | 1.2 | 1.4 | 30-65 | 55-85 | |
| Comp. Exam. 8 | 1.6 | 2.7 | 30-50 | 30-180 | |
| Exam. 9 | 0.8 | 1.0 | 30-65 | 50-85 | |
| Exam. 10 | 1.3 | 1.6 | 50-90 | 70-95 | |
| Comp. Exam. 9 | 2.0 | 3.5 | 40-120 | 90-165 | |

TABLE 2-continued

| | | | | | |
|---|---|---|---|---|---|
| Comp. Exam. 10 | 3.2 | 5.1 | 40-100 | 70-345 | Highly uniform Dispersion of Ag/Cu is inhibited |

TABLE 3

| | Contact Forming Material under Test Highly Conductive Component | | | | | |
|---|---|---|---|---|---|---|
| | Ag (wt %) | Cu (wt %) | [Ag + Cu] (wt %) | Ag / (Ag + Cu) x 100 | y / (x + y) × 100 x . . . Amount of First Highly Conductive Component Region y . . . Amount of Second Highly Conductive Component Region | Arc-proof Component Grain Size and Type of Arc-proof Component |
| Exam. 11 | 33.8 | 12.8 | 46.6 | 72.5 | 30-40% | 3 μm TiC |
| Exam. 12 | 36.5 | 12.6 | 49.1 | 74.3 | 30-40% | 3 μm VC |
| Exam. 13 | 34.7 | 13.6 | 48.3 | 71.8 | 30-40% | 3 μm $Cr_3C_2$ |
| Exam. 14 | 33.5 | 11.1 | 44.6 | 75.1 | 30-40% | 3 μm ZrC |
| Exam. 15 | 33.3 | 13.9 | 47.2 | 70.6 | 30-40% | 3 μm $Mo_2C$ |
| Exam. 16 | 32.5 | 13.0 | 45.5 | 71.4 | 30-40% | 3 μm $TiB_2$ |
| Exam. 17 | 35.6 | 13.2 | 48.8 | 72.9 | 30-40% | 3 μm $VB_2$ |
| Exam. 18 | 31.1 | 11.3 | 42.4 | 73.3 | 30-40% | 3 μm $CrB_2$ |
| Exam. 19 | 30.8 | 12.31 | 43.2 | 71.4 | 5% | 3 μm $ZrB_2$ |
| Exam. 20 | 33.9 | 11.8 | 45.7 | 74.1 | 10-30% | 3 μm $MoB_2$ |
| Exam. 21 | 31.6 | 11.3 | 42.9 | 73.6 | 40-60% | 3 μm $W_2B_5$ |
| Exam. 22 | 35.5 | 13.3 | 48.3 | 72.5 | 60-90% | 3 μm Ti |
| Exam. 23 | 32.4 | 13.7 | 46.1 | 70.2 | 30-40% | 3 μm V |
| Exam. 24 | 30.9 | 12.1 | 43.0 | 71.9 | 30-40% | 3 μm Cr |
| Exam. 25 | 34.2 | 11.5 | 45.7 | 74.8 | 30-40% | 3 μm Zr |
| Exam. 26 | 30.6 | 11.6 | 42.2 | 72.4 | 30-40% | 3 μm Mo |
| Exam. 27 | 34.2 | 12.4 | 46.6 | 73.3 | 30-40% | 3 μm W |

| | Evaluation Result | | | | |
|---|---|---|---|---|---|
| | Current Chopping Characteristic Relative Value obtained when the Average Value of Example 2 is expressed as 1.00 (Number of Contents: 3) | | Contact Resistance Characteristic | | |
| | Average | Maximum | Value during 1-100 Make-and-Break processes (μΩ) | Value during 9,900-10,000 Make-and-Break processes (μΩ) | Remark |
| Exam. 11 | 1.3 | 1.7 | 95-110 | 75-110 | |
| Exam. 12 | 1.2 | 1.5 | 90-100 | 80-100 | |
| Exam. 13 | 1.0 | 1.5 | 80-105 | 85-115 | |
| Exam. 14 | 1.3 | 1.7 | 80-105 | 85-110 | |
| Exam. 15 | 1.2 | 1.4 | 50-90 | 70-100 | |
| Exam. 16 | 1.7 | 1.9 | 80-105 | 70-120 | |
| Exam. 17 | 1.3 | 1.7 | 75-95 | 80-115 | |
| Exam. 18 | 1.3 | 1.6 | 75-100 | 90-130 | |
| Exam. 19 | 1.7 | 2.0 | 80-105 | 80-130 | |
| Exam. 20 | 1.3 | 1.7 | 65-90 | 75-95 | |
| Exam. 21 | 1.4 | 1.9 | 70-95 | 75-95 | |
| Exam. 22 | 1.7 | 2.0 | 70-95 | 75-100 | |
| Exam. 23 | 1.5 | 1.9 | 70-90 | 75-95 | |
| Exam. 24 | 1.4 | 1.7 | 70-90 | 70-100 | |
| Exam. 25 | 1.6 | 2.0 | 75-85 | 80-100 | |
| Exam. 26 | 1.5 | 1.8 | 55-80 | 60-80 | |
| Exam. 27 | 1.7 | 2.0 | 50-80 | 55-85 | |

As can be seen from the Examples described above, by controlling the total amount of highly conductive materials consisting of Ag and Cu(Ag+Cu), and the ratio of Ag to Ag+Cu[Ag/(Ag+Cu)], to specific values, by using the average grain size of the arc-proof components such as WC of from 0.5 to 1 micrometer and by controlling the amount of the second highly conductive component region in the highly conductive components to a specific value, current chopping characteristic can be maintained at a low level, scattering can be reduced and the contact resistance characteristic can be simultaneously maintained at a sufficiently low level. The addition of less than 1% of Co (cobalt) to the present alloy improves sinterability.

As stated hereinbefore, according to the present invention, the following advantages and effects are achieved. That is, the current chopping characteristic can be maintained at a low level and scattering can be reduced. Furthermore, the contact resistance characteristic can be simultaneously maintained at a low level.

Accordingly, when the contact forming material of the present invention is used, a vacuum interrupter having good current chopping characteristic and contact resistance characteristic can be obtained, and a vacuum interrupter having even greater stability of the current chopping characteristic can be provided.

We claim:

1. A contact forming material for a vacuum interrupter comprising: from 25% to 65% by weight of a highly conductive component comprising Ag and Cu; and from 35% to 75% by weight of an arc-proof component selected from the group consisting of Ti, V, Cr, Zr, Mo, W and their carbides and borides, and mixtures thereof;

said highly conductive component comprising (i) a first highly conductive component region being composed of a first discontinuous phase having a thickness or width of no more than 5 micrometers and a first matrix surrounding the first discontinuous phase, and (ii) a second highly conductive component region being composed of a second discontinuous phase having a thickness or width of at least 5 micrometers and a second matrix surrounding the second discontinuous phase, wherein said first discontinuous phase in said first highly conductive component region is finely and uniformly dispersed in said first matrix at intervals of no more than 5 micrometers, and wherein the amount of the second highly conductive component region based on the total highly conductive component is within the range of from 10% to 60% by weight.

2. The contact forming material for the vacuum interrupter according to claim 1, wherein said arc-proof component has an average grain size of from 0.1 to 5 micrometers and wherein a large portion of the arc-proof component is surrounded by the first highly conductive component.

3. The contact forming material for the vacuum interrupter according to claim 1, wherein the percentage of Ag based on the total amount of said highly conductive components Ag and Cu, [Ag/(Ag+Cu)], is from 40% to 80% by weight.

4. The contact forming material for the vacuum interrupter according to claim 1, wherein the discontinuous phases and matrices from which the first and/or second highly conductive component regions are formed are composed of either (i) in the case where matrix of the highly conductive component is a AG solid solution having Cu dissolved therein, the discontinuous phase comprises a Cu solid solution having Ag dissolved therein, or (ii) in the case where matrix of the highly conductive component is a Cu solid solution having Ag dissolved therein, the discontinuous phase comprises a Ag solid solution having Cu dissolved therein.

5. The contact forming material for the vacuum interrupter according to claim 1, wherein Ag and Cu having a grain size between 5 and 100 micrometers is present in the second highly conductive component.

6. The contact forming material for the vacuum interrupter according to claim 1, wherein said arc-proof component has an average grain size of no more than 1 micrometer.

7. The contact forming material for the vacuum interrupter according to claim 1, wherein said arc-proof component has an average grain size of no more than 0.8 micrometer.

8. The contact forming material for the vacuum interrupter according to claim 1, wherein said arc-proof component has an average grain size of no more than 0.6 micrometer.

9. The contact forming material for the vacuum interrupter according to claim 1, wherein said second highly conductive component region comprises Ag and Cu having an average grain size of at least 5 micrometers.

10. The contact forming material for the vacuum interrupter according to claim 14, wherein said first highly conductive component region comprises Ag and Cu having an average grain size of not more than 5 micrometers.

11. The contact forming material for the vacuum interrupter according to claim 15, wherein said arc-proof component has an average grain size of no more than 1 micrometer.

* * * * *